US008100154B2

(12) United States Patent
Reynolds et al.

(10) Patent No.: US 8,100,154 B2
(45) Date of Patent: Jan. 24, 2012

(54) RECONSTITUTION SYSTEM FOR MIXING THE CONTENTS OF A VIAL CONTAINING A FIRST SUBSTANCE WITH A SECOND SUBSTANCE STORED IN A CARTRIDGE

(75) Inventors: David L. Reynolds, Bromont (CA); Daniel MacDonald, Bromont (CA); Julie Trepanier, Rock Forest (CA); Roger McCarthy, Brigham (CA)

(73) Assignee: Duoject Medical Systems Inc., Bromont, Quebec (CA)

( * ) Notice: Subject to any disclaimer, the term of this patent is extended or adjusted under 35 U.S.C. 154(b) by 1103 days.

(21) Appl. No.: 11/974,737

(22) Filed: Oct. 16, 2007

(65) Prior Publication Data

US 2008/0172001 A1 Jul. 17, 2008

(51) Int. Cl.
*B65B 1/04* (2006.01)

(52) U.S. Cl. ..... 141/329; 141/319; 141/330; 604/412; 604/413

(58) Field of Classification Search ..... 141/319, 141/329, 330; 604/412, 413
See application file for complete search history.

(56) References Cited

U.S. PATENT DOCUMENTS

| | | | | | |
|---|---|---|---|---|---|
| 3,872,867 | A * | 3/1975 | Killinger | ..... | 604/413 |
| 3,923,059 | A * | 12/1975 | Ogle | ..... | 604/413 |
| 4,624,667 | A * | 11/1986 | Rutnarak | ..... | 604/414 |
| 5,356,380 | A * | 10/1994 | Hoekwater et al. | ..... | 604/85 |
| 5,641,010 | A * | 6/1997 | Maier | ..... | 141/329 |
| 5,989,237 | A * | 11/1999 | Fowles et al. | ..... | 604/413 |
| 6,063,068 | A * | 5/2000 | Fowles et al. | ..... | 604/414 |
| 6,209,738 | B1 * | 4/2001 | Jansen et al. | ..... | 215/247 |
| 6,558,365 | B2 * | 5/2003 | Zinger et al. | ..... | 604/410 |

* cited by examiner

*Primary Examiner* — Timothy L Maust
(74) *Attorney, Agent, or Firm* — Eric Fincham

(57) ABSTRACT

A transfer assembly for transfering a fluid to a vial, admixing the same and then returning the fluid to a cartridge, the transfer assembly having a vial gripper located at a first end and a cartridge holder at the second end of an elongated outer housing, a fluid passageway extending between the vial gripper and the cartridge holder with piercing elements being located at respective ends of the fluid passageway. In a preferred embodiment, an adaptor is mounted on the end of the outer housing where the cartridge holder is situated. The adaptor may move from a retracted to an extended position wherein it will surround the needle.

16 Claims, 8 Drawing Sheets

Fig. 8
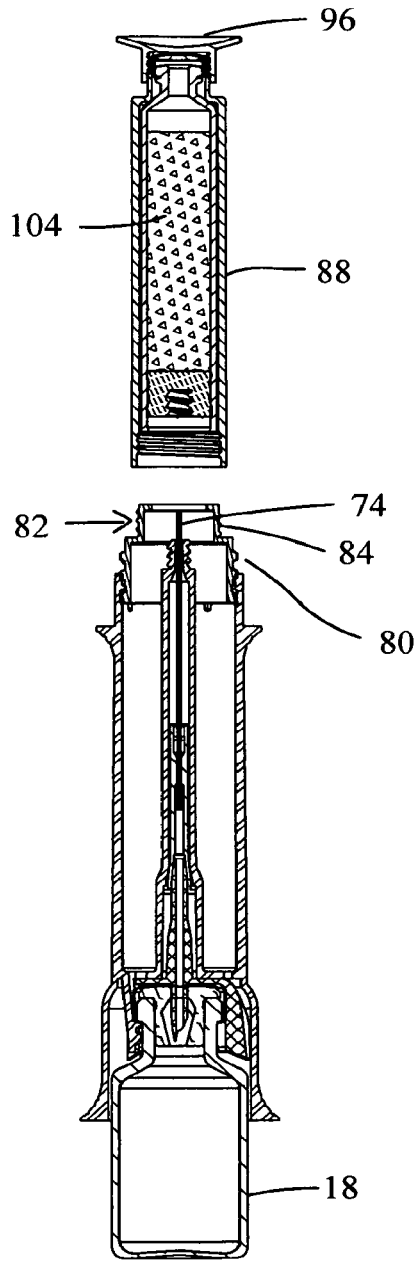
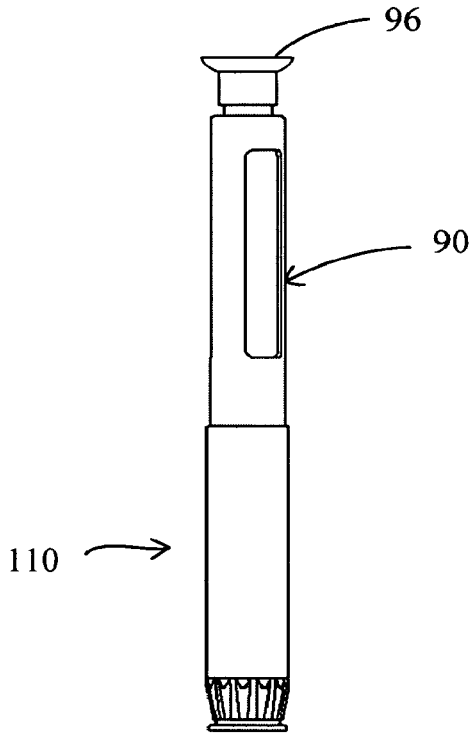
Fig. 9

RECONSTITUTION SYSTEM FOR MIXING THE CONTENTS OF A VIAL CONTAINING A FIRST SUBSTANCE WITH A SECOND SUBSTANCE STORED IN A CARTRIDGE

FIELD OF THE INVENTION

The present invention relates to a reconstitution system for mixing the contents of a vial with a second substance and which second substance is stored in a cartridge.

BACKGROUND OF THE INVENTION

In the pharmaceutical industry, it is frequently necessary to mix or dissolve a first pharmaceutical constituent with a second pharmaceutical constituent. The constituents may either be a powder and a liquid or two liquids. In many cases, the first of the constituents is a powder ingredient comprising the active medicinal ingredient which is conventionally stored in a vial while the second constituent is a liquid for dissolving or otherwise incorporating the powder ingredient.

In the prior art, it is well known to use a syringe to accomplish the mixing of two pharmaceutical substances. Traditionally, a syringe has been used for accomplishing this step. Thus, in the case of a solid and liquid component, the liquid component is packaged in the syringe with the solid component being packaged in a pharmaceutical vial having a neck closed by a penetrable closure. One then injects the liquid component into the vial through the penetrable closure, mixes the two substances together in the vial to dissolve, dilute or suspend the solid component in the liquid component, and subsequently aspirate the combined components back into the syringe. The above method is disadvantageous in the fact that the user is exposed to the unprotected needle tip and furthermore, loss of a pharmaceutical component can occur through the puncture point. This is particularly dangerous with certain pharmaceutical components such as toxic oncology pharmaceuticals. Still further, the sterility of the needle may be compromised during the process.

A solution to the above is shown in International Application PCT/CA2004/00006, the teachings of which are hereby incorporated by reference. In this patent application, a method of safely mixing two pharmaceutical components utilizing a syringe is shown.

A requirement in the pharmaceutical industry are cartridges which are secured to an injection pen. These cartridges are frequently used where there exists a multidose situation or metered amounts must be injected. A device for mixing two pharmaceutical components for use in an injection pen is required.

SUMMARY OF THE INVENTION

Accordingly, it is an object of the present invention to provide a reconstitution system for mixing the contents of a vial containing a first substance with the contents of a cartridge containing a second substance.

According to one aspect of the present invention, there is provided a transfer assembly comprising an elongated outer housing having first and second ends, a vial gripper located at the first end thereof, a cartridge holder, a first end of the cartridge holder being mounted within the outer housing at the second end thereof, the cartridge holder being slidable within the outer housing, an inner housing within the outer housing, the inner housing having first and second ends proximate the first and second ends of the outer housing respectively, a fluid passageway within the inner housing, a first end of the fluid passageway located proximate the first end of the inner housing and terminating in a first piercing element, a second end of the fluid passageway proximate the second end of the inner housing terminating in a second piercing element, and the second end of the inner housing being adapted to be secured to a plunger on a cartridge.

In a further aspect of the present invention, there is provided, in combination, a vial, the vial having a dry component therein, a cartridge, the cartridge having a liquid component therein, and a transfer assembly, the transfer assembly comprising an elongated outer housing having first and second ends, a vial gripper located at the first end thereof, a cartridge holder, a first end of the cartridge holder being mounted to the outer housing at the second end thereof, the cartridge holder being slidable within the outer housing, an inner housing within the outer housing, the inner housing having first and second ends proximate the first and second ends of the outer housing respectively, a fluid passageway within the inner housing, a first end of the fluid passageway located proximate the first end of the inner housing and terminating in a first piercing element, a second end of the fluid passageway proximate the second end of the inner housing terminating in a second piercing element, and the second end of the inner housing being adapted to be secured to a plunger on the cartridge.

In the description of the present invention, reference will be made to the contents of the vial being a material in a solid state with the contents of the cartridge being a liquid diluent. It will be understood that this is for purposes of explanation only and that other combinations may be utilized. As used herein, the two components (powder and the liquid) are referred to as an admixture. This will include any combination of two components whether it be a solution, suspension, etc.

The present invention provides a reconstitution system and method wherein the two components may be mixed and are ready for injection from a standard cartridge. The cartridge may be attached to known injection devices such as injection pens.

In one embodiment, the arrangement of the present invention is one wherein there is provided a cannula (a hollow needle) which is adapted to pierce a penetrable closure in the cartridge while there is provided a spike which is adapted to penetrate the penetrable closure in the vial. There is thus established a continuous fluid passageway between the vial and the cartridge. A needle hub assembly may be utilized to hold the cannula.

The attachment system in this embodiment is such that the plunger rod is screw threadably engaged with the penetrable closure in the cartridge. An adaptor member is also screw threadably engaged with the cartridge holder and with an upper end of the housing. However, only limited unscrewing of the same is permitted such that the same screwing motion or action will also allow the unscrewing of the adaptor from the cartridge holder subsequent to which the cartridge holder may be connected to an injection device such as a pen. Utilizing this arrangement, the needle remains within the housing and accordingly, does not pose a danger to the user of the device.

In one embodiment of the present invention, the piercing elements comprise a single cannula which has a fluid passageway therein.

BRIEF DESCRIPTION OF THE DRAWINGS

Having thus generally described the invention, reference will be made to the accompanying drawings illustrating an embodiment thereof, in which:

FIG. 8 illustrates the final removal of the cartridge and cartridge holder;

FIG. 9 is a elevational view illustrating placement of the cartridge and cartridge holder in a pen;

Figure 2:
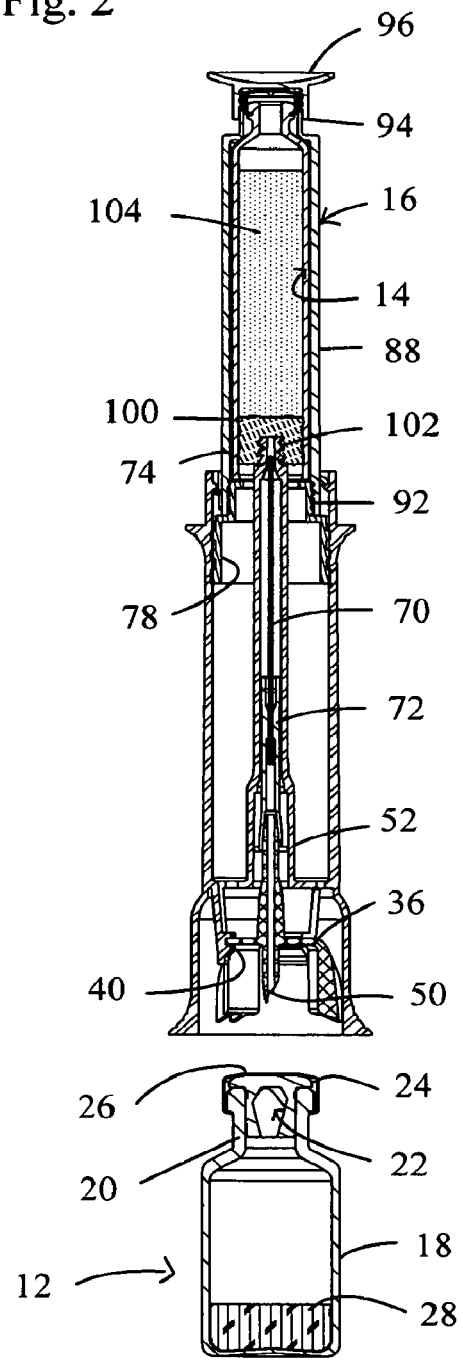
FIG. 2 is a sectional view thereof.
Figure 1:
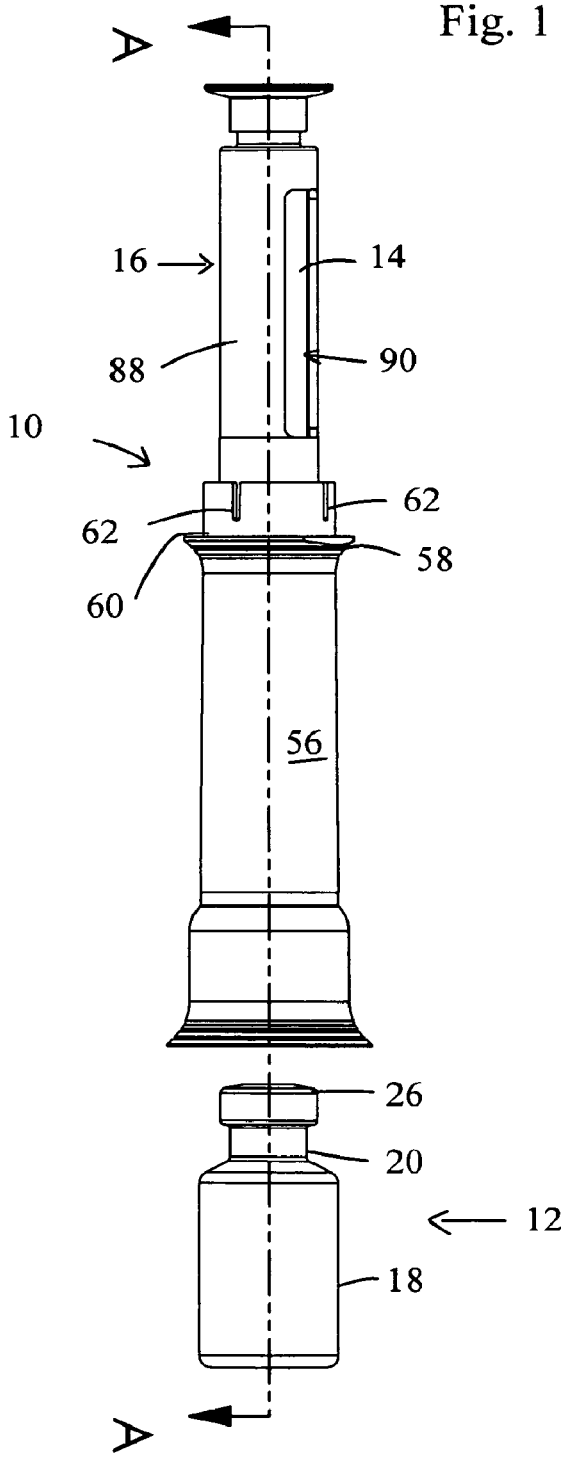
FIG. 1 is a side elevational view of the reconstitution system and the vial.

Referring to the drawings in greater detail and by reference characters thereto, there is illustrated a reconstitution system which includes a transfer assembly generally designated by reference numeral 10, a vial generally illustrated by reference numeral 12, a cartridge generally designated by reference numeral 14, and a cartridge holder generally designated by reference numeral 16.

Vial 12 has a cylindrically shaped body 18 with a reduced area neck 20 surrounding a mouth 22. Placed within mouth 22 is a penetrable closure 16 which is covered by a cap 26. Vial 12 has a powder 28 which usually comprises and active medical ingredient and which fills only a portion of the body 18.

Figure 10:
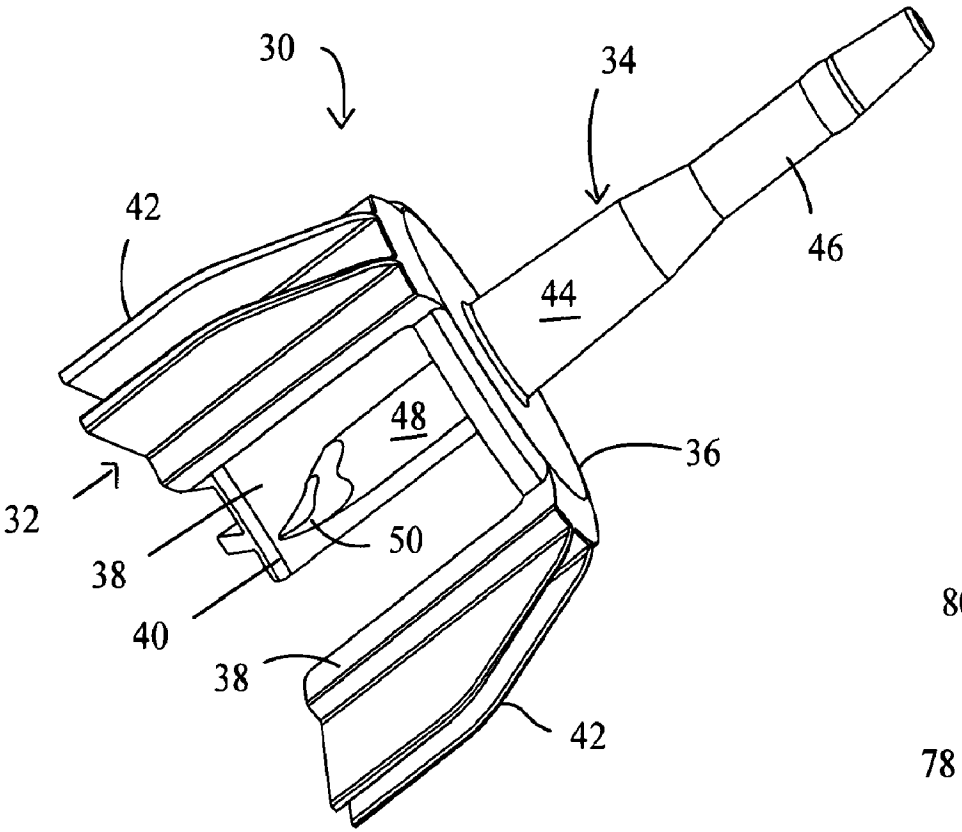
FIG. 10 is an enlarged view of the connector portion of the transfer assembly.

Transfer assembly 10 includes a connector 30 which is best illustrated in FIG. 10. Connector 30 includes a vial gripping portion generally designated by reference numeral 32 and an upper tubular portion generally designated by reference numeral 34. Connector 30 has an upper wall 36 with downwardly extending grippers 38. At the lower end of the grippers 38, there is provided an inwardly extending flange 40 for engaging vial 12 as will be shown in greater detail hereinbelow. A pair of ribs 42 are provided on each of the grippers.

Tubular portion 34 has a lower section 44 and an upper section 46 which is of reduced diameter compared to lower section 44. Extending downwardly into the vial gripping portion 32 is a spike 48 having a sharp edge 50 designed to penetrate penetrable closure 24 as will be described in greater detail hereinbelow. A fluid passageway 52 extends through spike 48.

Figure 13:
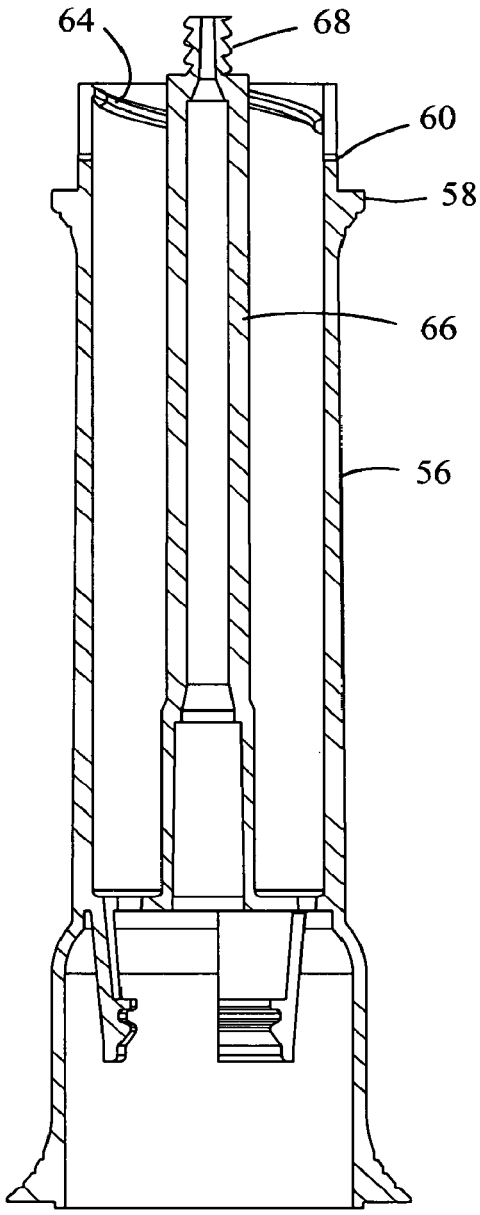
FIG. 13 is sectional view taken along the lines A-A of FIG. 12.
Figure 12:
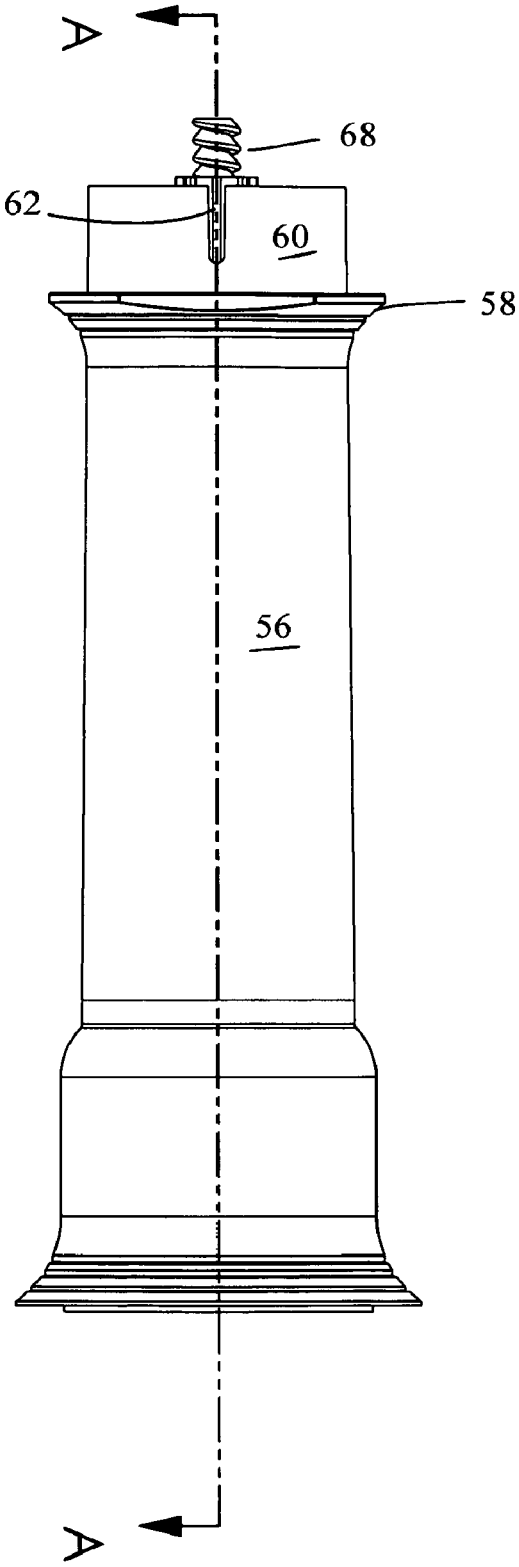
FIG. 12 is an elevational view of the transfer assembly.

Transfer assembly 10 includes an outer housing 56 which is best seen in FIGS. 12 and 13. Outer housing 56 includes an enlarged portion 58 to separate the main body of outer housing 56 and an upper portion 60. Upper portion 60 includes vertically extending slits 62 therein to provide flexibility if required. On the inner wall of upper portion 60 there is provided a screw thread 64.

An inner housing 66 terminates in an upper threaded portion 68. Mounted interiorly of inner housing 66 is needle or cannula 70 which is mounted in a needle hub 72.

Figure 11:
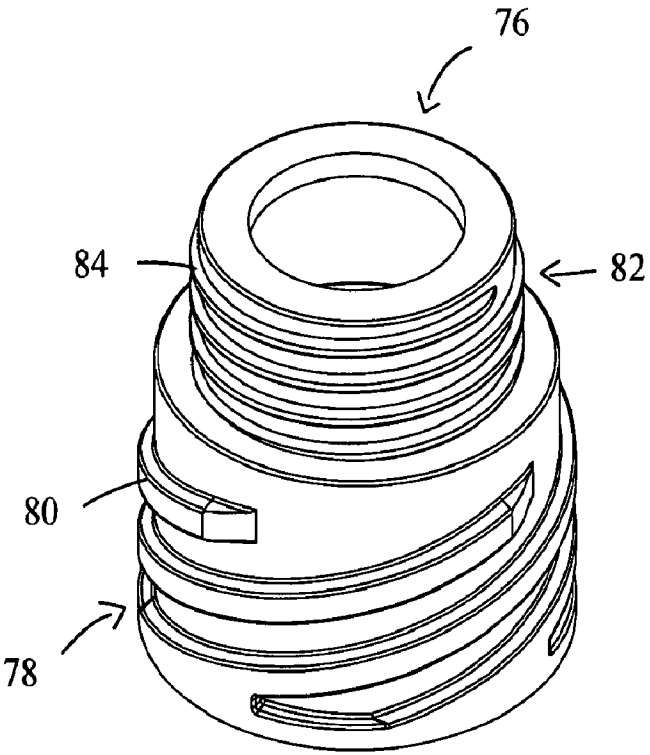
FIG. 11 is a perspective view of the threaded adaptor of the transfer assembly.

Located at the upper end of outer housing 56 is an adaptor generally designated by reference numeral 76 and which is best illustrated in FIG. 11. Adaptor 26 includes a lower body portion 78 which has threads 80 on the exterior surface thereof. In this respect, threads 80 are designed to permit threaded engagement with threads 64 but are of the type which restrict the unscrewing of connector 76 at a desired point.

As previously mentioned, cartridge 14 is mounted within a cartridge holder 16 which has a cylindrical body 88. There are provided a plurality (preferably 2) longitudinally extending slots 90 in body 88. A lower portion of body 88 has threads 92 formed on an air portion thereof for engagement with threads 84 of upper portion 82 of adaptor 76. An upper portion of cylindrical body 16 is of reduced diameter and has outer threads 94 designed to engage with a threaded cap 96.

A penetrable plunger 100 has an aperture with threads 102 thereabout. Threads 102 are designed to engage in a screw threaded manner with threads 68 formed on inner housing 66. Placed within plunger body 88 is a diluent 104.

The initial positioning of the components is shown in FIG. 2. In this initial position, threads 80 of lower body 78 of adaptor 76 have been engaged with threads 64 on the upper portion 60 of outer housing 56. Adaptor 76 is thus slidable within outer housing 56. Plunger 100 is also screw threadably engaged with threads 68 on inner housing 66. Vial 12 is aligned with vial gripping portion 32.

Subsequently, vial 12 is inserted within vial gripping portion 32. The vial is inserted until cap 26 is abutting top wall 36 of connector 30. At this position, spike 48 has penetrated closure 24 to gain access to the interior of vial 12.

Figure 3:
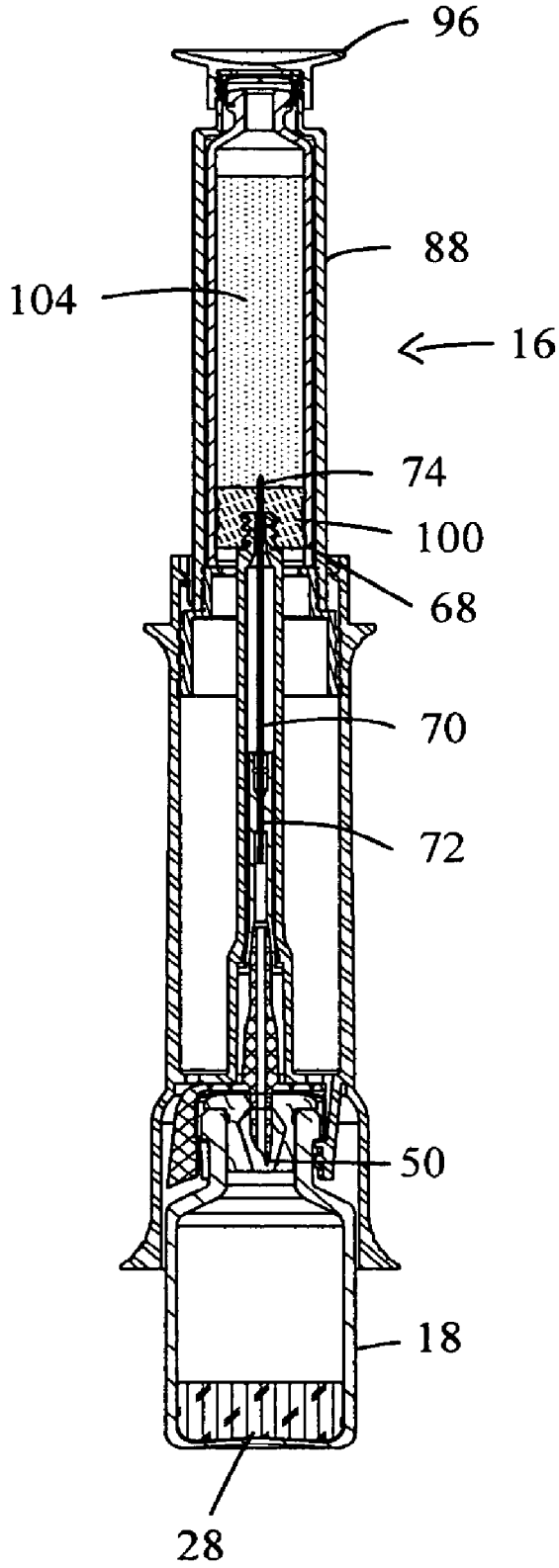
FIG. 3 is a sectional view showing activation of the system.

Continuing insertion of vial 12 will cause connector 30 to move upwards to the position as shown in FIG. 3. This will cause cannula 70 to penetrate plunger 100 of cartridge 14. Thus, a fluid passageway is established between vial 12 and cartridge 14.

Figure 4:
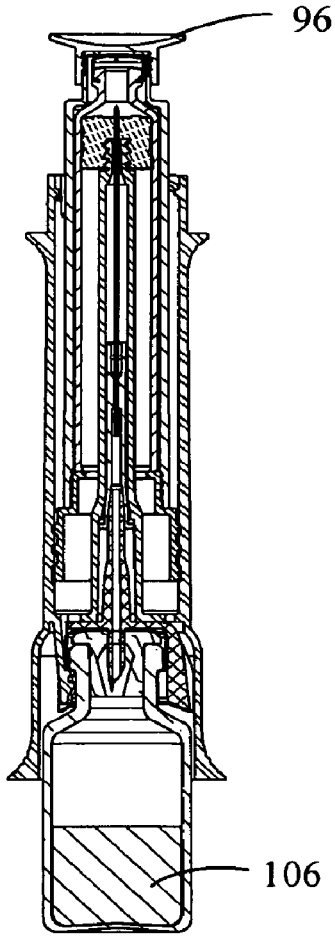
FIG. 4 is a sectional view showing transfer of the diluent to the vial.

Downward pressure is then exerted on cartridge holder 16 by means of cap 96. This position is shown in FIG. 4 wherein diluent 104 has been transferred to vial 12. At this point, the admixture may be shaken or otherwise mixed until the desired result is achieved.

Figure 5:
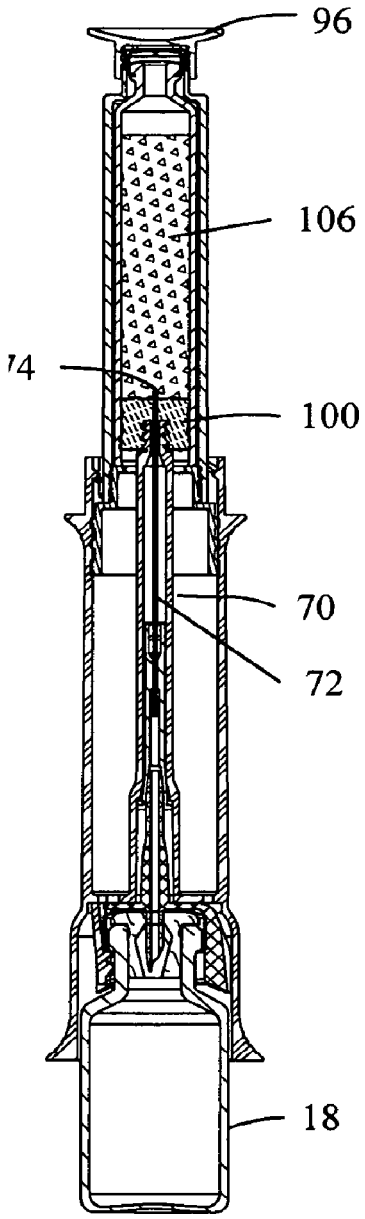
FIG. 5 is a sectional view showing aspiration of the admixture into the cartridge.

An aspiration step follows as show in FIG. 5 wherein the admixture 106 is transferred back to cartridge 14 as cartridge holder 16 is advanced upwardly.

Figure 7:
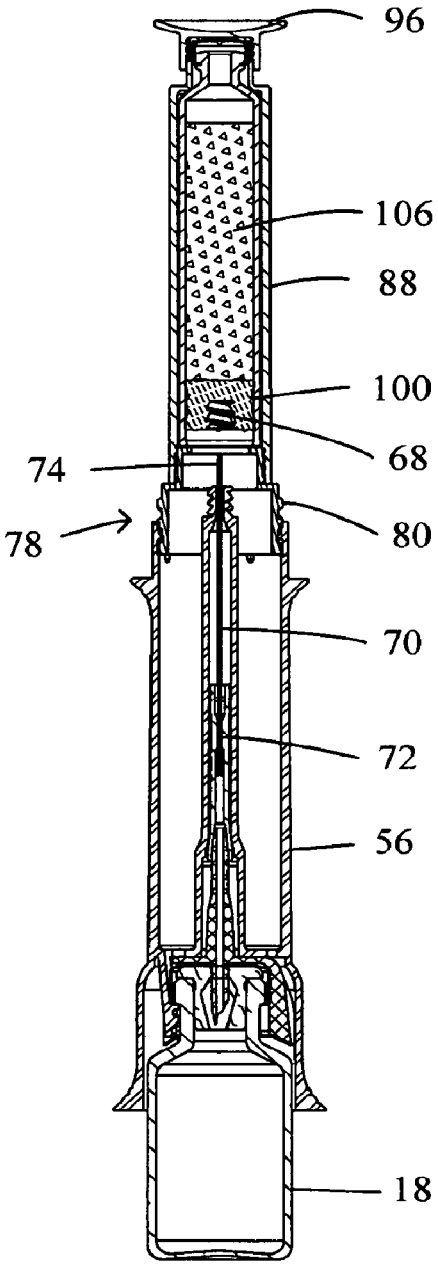
FIG. 7 is a sectional view illustrating removal of the cartridge and cartridge holder.
Figure 6:
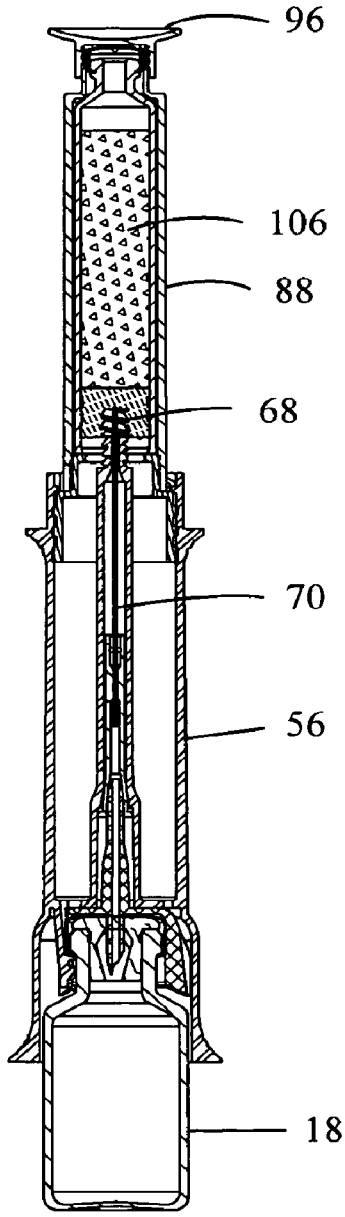
FIG. 6 is a sectional view illustrating the commencement of the removal of the cartridge holder.

Cartridge holder 16 is then turned or rotated to unscrew adaptor 76 relative to upper portion 60 of outer housing 56. As previously mentioned, adaptor 76 can only be unscrewed for a certain distance. Subsequently, cartridge 14 may be accessed through slot 90 to prevent rotation thereof and cartridge holder 16 is rotated such that cartridge 14 is unscrewed from thread 68 on inner housing 66. This position is shown in FIG. 7. As shown in FIG. 8, the cartridge and cartridge holder are completely unscrewed and ready for use. Threads 92 can then be used for attachment of the cartridge and cartridge holder to an injection pen 110 as shown in FIG. 9.

Figure 15:
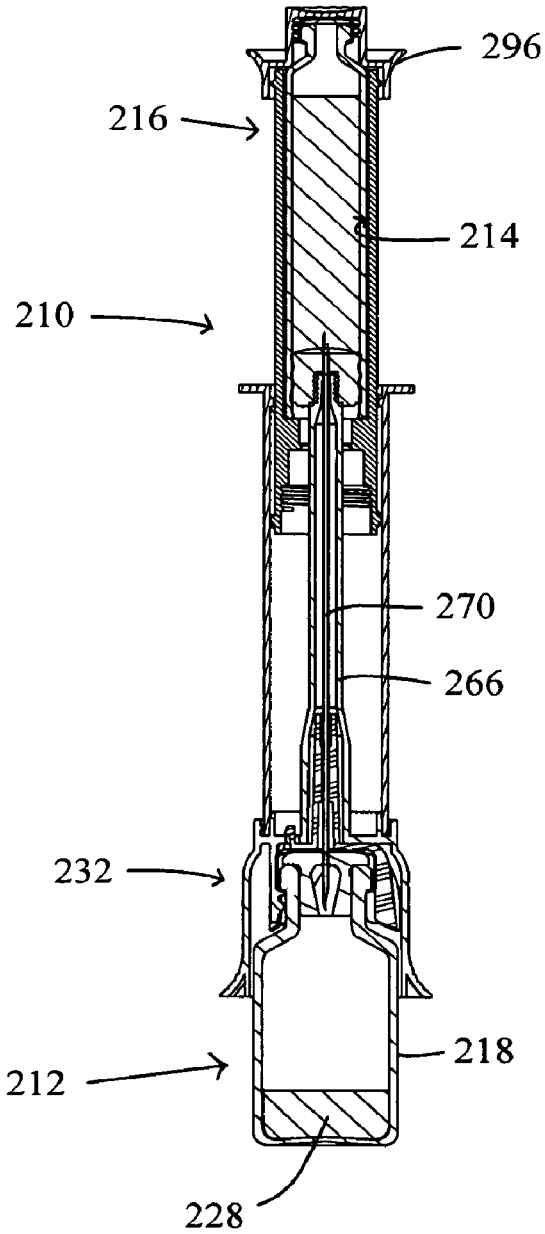
FIG. 15 is a side sectional view of the embodiment of FIG. 14 showing initial activation of the device.
Figure 14:
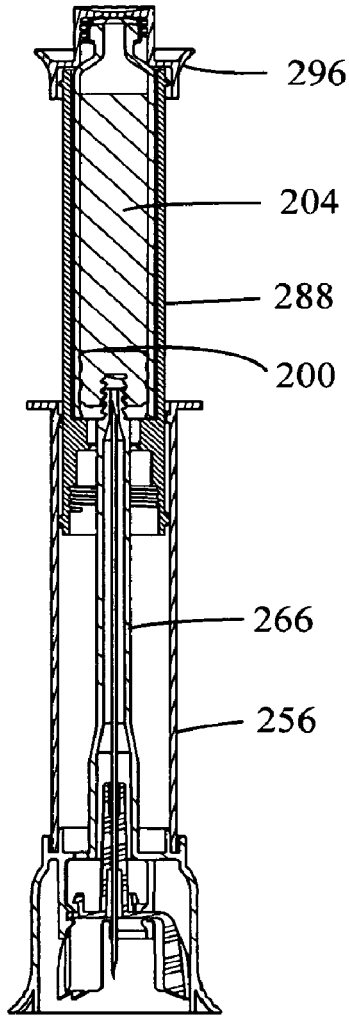
FIG. 14 is a side sectional view of a further embodiment of a transfer assembly according to the present invention.

In the embodiment of FIGS. 14 and 15, similar reference numerals in the 200's are utilized to describe or designate similar components than in the previously described embodiment. Thus, there is provided a transfer assembly generally designated by reference numeral 210 and which is adapted to be utilized with a vial 212, a cartridge 214 and a cartridge holder 216.

Vial 212 contains a pharmaceutical component 228. During activation, vial 212 is inserted into vial gripping portion 232 in a manner previously described and accordingly, will not be discussed in detail herein. In this embodiment, it is to be noted that needle 270 extends the entire distance within inner housing 266 and thus provides both of the piercing elements.

At its upper end, outer housing 256 does not utilize an adaptor as was the case in the previously described embodiment. Rather, cylindrical body 188 of cartridge holder 216 remains within outer housing 256. A cap 296 is screwthreadedly engaged with the upper portion of cylindrical body 288 and when removed, access may be had to cartridge 214.

It will be understood that the above described embodiment is for purposes of illustration only and that changes and modifications may be made thereto without departing from the spirit and scope of the invention.

We claim:

1. A transfer assembly comprising:

an elongated outer housing having first and second ends;

a vial gripper located at said first end thereof;

a cartridge holder, a first end of said cartridge holder being mounted within said outer housing at said second end thereof, said cartridge holder being slidable within said outer housing;

an inner housing within said outer housing, said inner housing having first and second ends proximate said first and second ends of said outer housing respectively;

a fluid passageway within said inner housing, a first end of said fluid passageway located proximate said first end of said inner housing and terminating in a first piercing element;

a second end of said fluid passageway proximate said second end of said inner housing terminating in a second piercing element; and said second end of said inner housing being adapted to be secured to a plunger on a cartridge;

an adaptor mounted on said second end of said outer housing, said adaptor being moveable between a retracted position and an extended position, said adaptor is screwthreadedly engaged with said outer housing.

2. The transfer assembly of claim 1 wherein said adaptor has a blocking portion to stop said adaptor from being fully detached from said outer housing.

3. The transfer assembly of claim 2 wherein said adaptor is screwthreadedly engaged with said cartridge housing.

4. The transfer assembly of claim 2 wherein said piercing element at said second end comprises a cannula.

5. The transfer assembly of claim 2 further including a cap screw threadedly engaged with a second end of said cartridge holder.

6. The transfer assembly of claim 2 further including at least one opening in said cartridge holder.

7. The transfer assembly of claim 6 further including a plurality of openings in said cartridge holder.

8. The transfer assembly of claim 4 further including a needle hub located interiorly of said inner housing, said needle hub having said cannula connected at one end thereof.

9. The transfer assembly of claim 1 wherein said vial gripper includes a plurality of latches designed to retain a neck of a vial.

10. The transfer assembly of claim 1 wherein said first piercing end extends into said vial gripper such that when a vial is inserted therein, said piercing end will pierce a piercable top sealing said vial.

11. The transfer assembly of claim 10 wherein said cannula has a length such that when said adaptor is in said extended position, said second piercing end is within said adaptor.

12. The transfer assembly of claim 1 wherein said outer housing has a plurality of slits at said first end, each of said slits extending from said first end.

13. The transfer assembly of claim 1 wherein said first and second piercing elements are at respective ends of a cannula, said cannula defining said fluid passageway.

14. The combination of claim 9 further including a plurality of openings in said cartridge holder.

15. The combination of claim 9 wherein said vial gripper includes a plurality of latches designed to retain a neck of a vial.

16. In combination, a vial, said vial having a dry component therein, a cartridge, said cartridge having a liquid component therein, and a transfer assembly, said transfer assembly comprising:

an elongated outer housing having upper and lower ends;

a vial gripper located at said lower end thereof;

a cartridge holder, a first end of said cartridge holder being mounted to said outer housing at said second end thereof, said cartridge holder being slidable within said outer housing;

an adaptor, said adaptor having an upper male thread on an exterior surface thereof and a lower male thread on a an exterior surface thereof, said upper male thread being engageable with a lower end of said cartridge holder, said lower male thread being engageable with said upper end of said outer housing, the arrangement being such that said adaptor can be rotated in a first direction to permit said adaptor to slide within said outer housing and when rotated in a second direction, said adaptor is prevented from extending outwardly from said outer housing more than a predetermined distance;

an inner housing within said outer housing, said inner housing having upper and lower ends proximate said upper and lower ends of said outer housing respectively;

a fluid passageway within said inner housing, a first end of said fluid passageway located proximate said upper end of said inner housing and terminating in a first piercing element;

a second end of said fluid passageway proximate said lower end of said inner housing terminating in a second piercing element;

said cannula having a length such that when said adaptor is in said extended position, said second piercing end is within said adaptor; and said upper end of said inner housing being adapted to be secured to a plunger on said cartridge.

* * * * *